US010766579B1

(12) United States Patent
Kerns, IV

(10) Patent No.: US 10,766,579 B1
(45) Date of Patent: Sep. 8, 2020

(54) PASSIVE HEAVE COMPENSATED DAVIT

(71) Applicant: United States of America as Represented by the Secretary of the Navy, Arlington, VA (US)

(72) Inventor: Maris Vernon Kerns, IV, Hayes, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/379,362

(22) Filed: Apr. 9, 2019

Related U.S. Application Data

(60) Provisional application No. 62/655,018, filed on Apr. 9, 2018.

(51) Int. Cl.
*B63B 39/02* (2006.01)
*B63B 23/04* (2006.01)

(52) U.S. Cl.
CPC ..... *B63B 39/02* (2013.01); *B63B 23/04* (2013.01)

(58) Field of Classification Search
CPC ..... B63B 39/02; B63B 23/04; B63B 27/10; B66C 13/04; B66C 13/06; B66C 23/52; B66C 23/53; B66C 23/84; B66D 1/50
See application file for complete search history.

(56) References Cited

U.S. PATENT DOCUMENTS 6,082,947 A * 7/2000 Adamson ..... B63B 27/10 212/308
9,457,874 B2 * 10/2016 Jacobsen ..... B66C 13/02
9,688,490 B2 * 6/2017 Maij ..... B63B 27/10
2015/0151953 A1 * 6/2015 Weterings ..... B66C 13/08 212/273
2016/0152451 A1 * 6/2016 Vestre ..... B66D 1/08 212/291
2018/0079631 A1 * 3/2018 Boroy ..... B63B 27/08
2020/0122982 A1 * 4/2020 Van Veluw ..... B66C 23/52

FOREIGN PATENT DOCUMENTS

WO WO-2014109637 A1 * 7/2014 ..... B63B 27/10

* cited by examiner

*Primary Examiner* — Anthony D Wiest
(74) *Attorney, Agent, or Firm* — Dave Ghatt

(57) ABSTRACT

The invention is directed towards a passive heave compensation arrangement for compensating for heave events in the open water, when loading or offloading/launching objects. The arrangement is part of a system that includes a water vessel that is operating on open water, a davit, and an object to be loaded/offloaded. The davit includes a stanchion, a boom, and a capture head for capturing objects within the head. The arrangement includes first and second winches, as well as a gas spring that applies forces to the boom in response to heave events, the gas spring as a part of the arrangement, passively compensating for every heave event.

3 Claims, 10 Drawing Sheets

PASSIVE HEAVE COMPENSATED DAVIT

CROSS-REFERENCE TO RELATED APPLICATIONS

This application claims the benefit of U.S. Provisional Application No. 62/655,018 filed Apr. 9, 2018, which is incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a passive heave compensation arrangement that compensates for heave events in the open water, when loading or offloading/launching objects. The arrangement is part of a system that includes a water vessel that is operating on open water, a davit, and an object to be loaded/offloaded.

BACKGROUND

Larger parent ships often recover smaller surface water vessels, such as manned or unmanned surface water vessels (USVs), and other water-bound objects to perform maintenance operations, to store, or to transport to other locations. Typically, the recovery of a smaller vessel or object is accomplished by positioning the smaller vessel alongside a stationary larger/parent ship and lifting the smaller vessel or object by davit into the parent ship. Similarly, the davit may be used to offload the smaller vessel or object, from the larger/parent ship into the open water These operations are affected by the elements of the sea environment and mooring arrangements. Even relatively small waves can induce large motions between the parent ship and davit, and the object/vessel being recovered from the open water. Without some sort of compensation for these environmental conditions in which waves induce relative motion between the larger/parent ship and the object being loaded, the safety and performance of loading and offloading operations may be severely limited.

Throughout the years, different solutions have been sought to solve the problem of heave-compensation during different sea states. Computer models have been used to accommodate for the dynamic properties of system elements. Equipment have incorporated mechanical stabilizers to adjust for wave motion. However, these attachments tend to add undesired bulk and complexity to the system apparatus. It is desired to have a davit device that captures, loads and unloads objects onto the parent ship, and passively compensates for heave motions triggered by the environmental conditions of the open water.

SUMMARY

In one aspect, the invention is a passive heave compensation system for the at-sea loading and unloading of objects on a water vessel. In this aspect, the system includes a water vessel having a bow and a stem, and a vessel centerline extending in a bow-to-stern direction. The water vessel has an upper deck. The water vessel is afloat in a body of water. The passive heave compensation system also includes, an object having a centerline, to be loaded and/or unloaded onto or from the water vessel. The passive heave compensation system also includes a passive heave compensation arrangement. The passive heave control arrangement includes a slewing gear attached to the upper deck of the water vessel and a stanchion extending axially in the vertical direction. The stanchion has a deck-attachment end and a boom-attachment end. At the deck-attachment end the stanchion is attached to the upper deck via the slewing gear so as to be rotatable about the vertical axis. The passive heave control arrangement also includes a boom extending axially and generally in a horizontal direction or at an angle to the horizontal direction. The boom has a stanchion-attachment end with an elbow thereat, and a head-attachment end. The passive heave control arrangement further includes a first pin having an elongated first pin axis, wherein the boom is attached to the stanchion via the first pin, the boom pivotable with respect to the stanchion about the first pin axis $Z_1$. The passive heave control arrangement further includes a capture head attached to the head end of the boom for capturing and cradling the object. There is a first winch on the stanchion, the first winch including a first winch cable connected to the elbow of the boom, whereat the first winch manipulates the pivoting motion of the boom about the first pin axis Z1. There is a second winch on the boom, the second winch including a second winch cable that extends into the capture head and is connectable to the object, whereat the second winch manipulates capturing and cradling of the object from either the upper deck or the body of water, and wherein the in the at-sea capturing and cradling of the object that is floating in the body of water, the vertical distance between the capture head and the object is a Reel Distance $R_d$. Furthermore, during a heave event a Heave Distance $H_d$ is the vertical displacement distance, with respect to the water vessel, the object moves under the force of the water. According to this aspect, the vertical displacement distance may be an upward displacement or a downward displacement. The passive heave compensation arrangement also includes an elongatable and retractable gas spring extending from the stanchion to the elbow of the boom. During a heave event the gas spring provides passive heave compensation by elongating if the Heave Distance $H_d$ moved by the object is a downward displacement or retracting if the Heave Distance $H_d$ moved by the object is an upward displacement, to negate the vertical displacement distance $H_d$ applying a force to move the boom by the Heave Distance $H_d$, thereby keeping the Reel Distance a constant during the heave event.

BRIEF DESCRIPTION OF THE DRAWINGS

Other features will be apparent from the description, the drawings, and the claims.

DETAILED DESCRIPTION

Figure 1A:
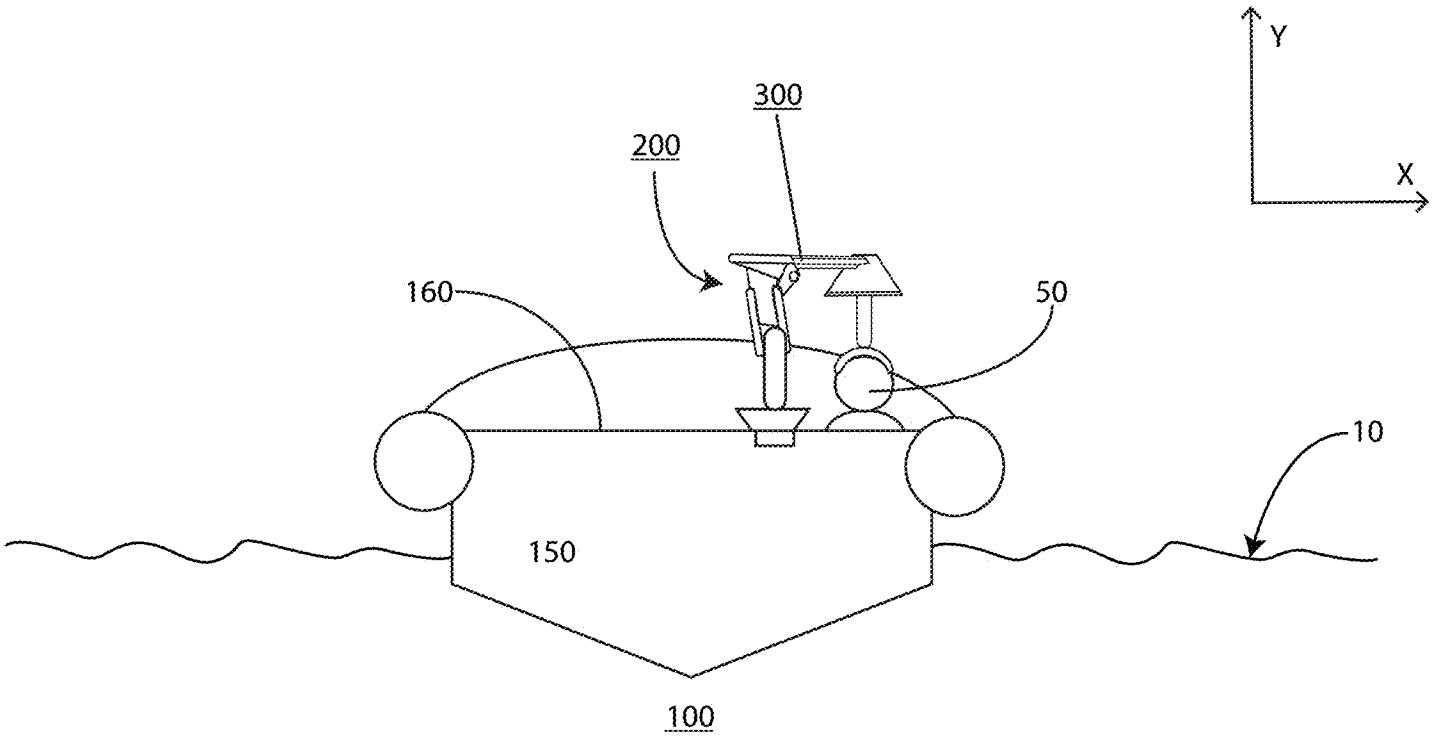
FIGS. 1A and 1B are exemplary perspective views of a passive heave compensation system for the open-water loading and unloading of objects on a water vessel, according to an embodiment of the invention.
Figure 1B:
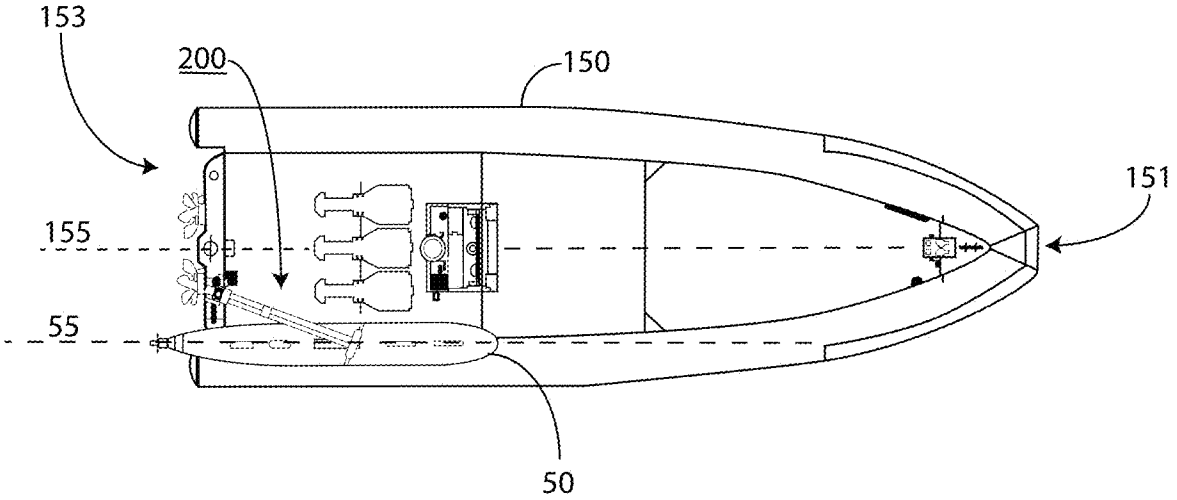

FIGS. 1A and 1B are exemplary perspective views of a passive heave compensation system 100 for the open-water loading and unloading of objects 50 on and off a water vessel/parent ship 150, according to an embodiment of the invention. Objects 50 may be manned or unmanned surface water vessels (USVs), manned or unmanned undersea vessels (UUVs) and any other water-bound objects. As outlined below, the system 100 operates in the open water, and includes a passive heave control arrangement 200 which includes a davit 300. The passive heave control arrangement 200 accommodates for the heave events associated with the sea states of the open water.

As shown in FIGS. 1A and 1B, the passive heave compensation system 100 includes the water vessel/parent ship 150. FIG. 1B shows the water vessel 150 having a bow 151 and a stem 153, and a vessel centerline 155 extending in a bow-to-stern direction. FIG. 1A shows the water vessel 150 having an upper deck 160. FIG. 1A also shows the water vessel 150 afloat on a body of water 10. The body of water 10 may be the sea, a river, a lake, or the like. FIGS. 1A and 1B also show an object 50, which according to an embodiment of the invention, may have a substantially cylindrical shape. The object 50 may also include a centerline 55 (shown in FIG. 1B) extending axially through the object. As outlined below, according to the invention, during the at-sea loading and offloading of objects on and off a water vessel/parent ship 150, the centerline 55 of the object 50 is kept substantially parallel to the vessel centerline 155.

FIGS. 1A and 1B also show a passive heave compensation arrangement 200. FIG. 1A shows the davit 300 which forms a part of the overall passive heave compensation arrangement 200. The davit 300 will be outlined in greater detail below, but as shown in FIG. 1A, includes a stanchion extending axially in the vertical direction Y, and a boom extending axially in the horizontal direction X. In the illustrations of FIGS. 1A and 1B, the passive heave compensation arrangement 200, including the davit 300 is arranged in the stowed position.

Figure 2A:
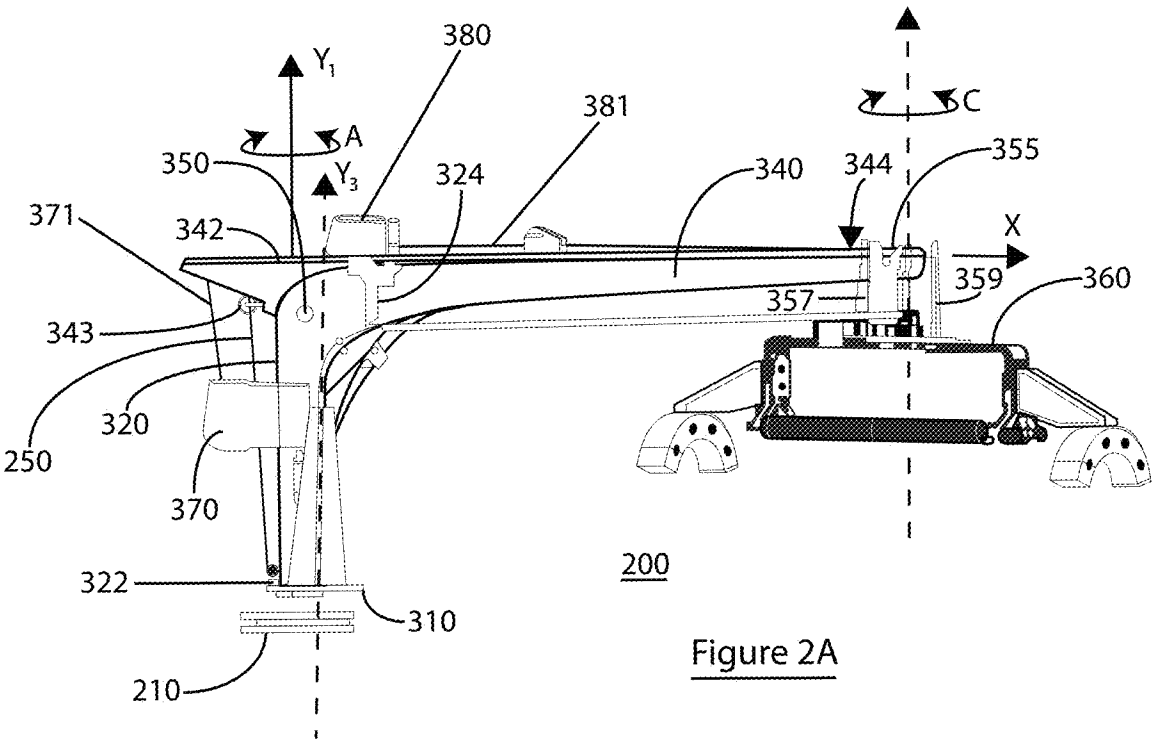
FIGS. 2A and 2B are perspective illustrations of the passive heave control arrangement, according to an embodiment of the invention.
Figure 2B:
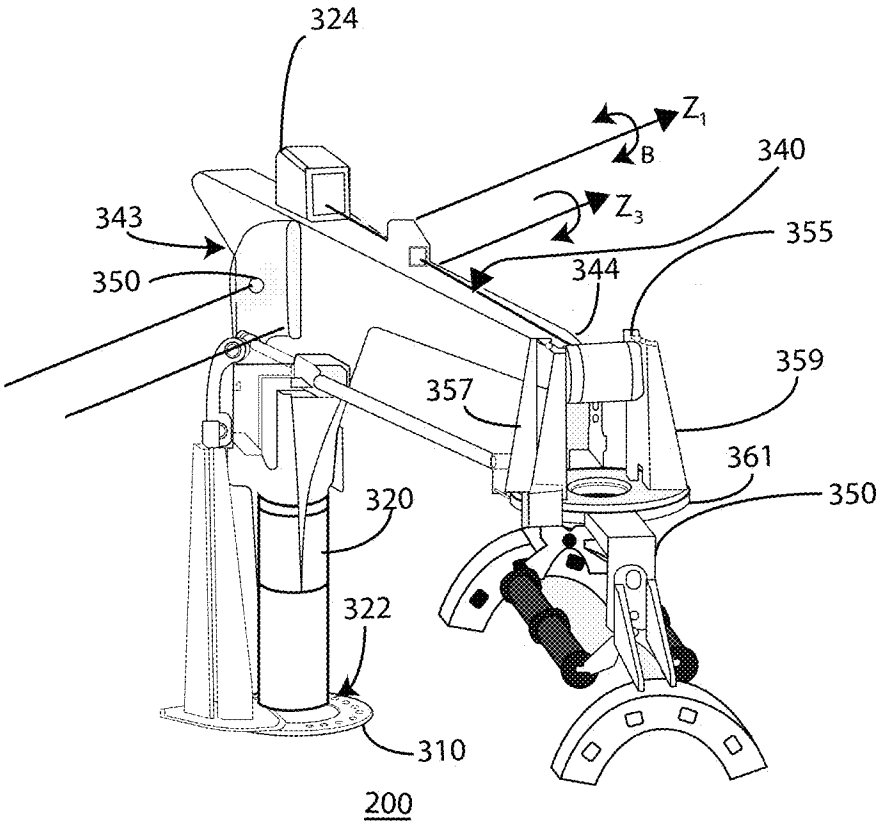

FIGS. 2A and 2B are perspective illustrations of the passive heave control arrangement 200, which includes the davit 300, according to an embodiment of the invention. The illustrations of FIGS. 2A and 2B show the arrangement 200 in identical position, but for clarity, shows the elements from different perspectives. FIGS. 2A and 2B show davit 300, having a stanchion 320, a boom 340, and a capture head 360, which are the primary linking arms/members for capturing, loading, and off-loading objects onto and off the water vessel 150 (not shown).

FIG. 2A is a side view perspective of the passive heave control arrangement 200. FIG. 2A shows a slewing gear 210, which may be driven by any known driving device, which may include motors, gears, transmission elements, and the like. The slewing gear 210 is positioned at the upper deck 160 (not shown) of the water vessel 150 (not shown). FIG. 2A shows the stanchion 320 extending axially in the vertical direction $Y_1$. As shown, the stanchion 320 has a deck-attachment end 322, having a slewing gear attachment 310. FIG. 2A also shows a boom-attachment end 324. The deck-attachment end 322 is attached to the upper deck via the mating connection between the slewing gear 210 and the slewing gear attachment 310. Through this attachment between the slewing gear 210 and the slewing gear attachment 310, the stanchion 320 is rotatable about the vertical axis $Y_1$, as indicated by arrow A.

FIG. 2A also shows the boom 340 extending axially generally horizontally in a direction X. However as outlined below, the boom 340 may pivot downwards at an angle to the horizontal. The boom 340 has a stanchion-attachment end 342 with an elbow 343 thereat, and a head-attachment end 344. FIG. 2A shows a first pin 350 having an elongated first pin axis $Z_1$ (going into the page). The axis $Z_1$ is illustrated in FIG. 2B. The boom 340 is attached to the stanchion 320 via the first pin 350. The boom 340 is pivotable with respect to the stanchion 320 about the first pin axis $Z_1$. The axis $Z_1$ is illustrated in FIG. 2B, with arrow B showing how the boom 340 rotates with respect to the stanchion. FIGS. 2A and 2B show the capture head 360 attached to the head-attachment end 344 of the boom for capturing and cradling an object.

FIGS. 2A and 2B also show a head-attachment assembly 355 that is attached to the head-attachment end 344 of the boom 340. As shown, the head-attachment assembly includes a first plate 357 and a second plate 359, wherein each of the first plate 357 the second plate 359 has a common pivot axis $Z_2$ through which the capture head 360 freely pivots to maintain the horizontal orientation of the object. FIGS. 2A and 2B also show a swivel disk 361, which is structured to rotate about a vertical axis $Y_2$. As shown, both the first plate 357 and the second plate 359 are attached to the swivel disk 361, through which the capture head swivels about the vertical axis $Y_2$ in the direction shown by arrow C.

FIGS. 2A and 2B also show the passive heave control arrangement 200 having a first winch 370 on the stanchion 320. The first winch 370 has a first winch cable 371 connected to the elbow 343 of the boom. As outlined below, the first winch 370 is actually a boom winch and it manipulates the pivoting motion of the boom 340 about the first pin axis $Z_1$, shown by arrow B. Thus, depending on the stage of operation as outlined below, when the first winch 370 reels in the cable 371, the boom 340 pivots about the first pin axis $Z_1$ in an anti-clockwise direction, thereby lifting the boom 340 upwards. As outlined below, it should be noted that when the first winch 370 releases the cable 371, the boom 340 does not pivot about the first pin axis $Z_1$ in a clockwise direction. A gas spring 250 (outlined below) keeps the boom 340 in the up position allowing slack cable 371 to come off of first winch 370. This slack cable 371 is necessary for heave compensation.

FIGS. 2A and 2B show a second winch 380 on the boom 340, the second winch including a second winch cable 381 that extends into the capture head 360 and is connectable to the object (not shown). A hook (not shown) may be connected to the end of the cable/line 381 for securing the object with the cable 381. The second winch 380, which is a line winch, reels in and releases the cable 381 to manipulate the capturing and cradling of the object from either the upper deck 160 (not shown) or from the body of water 10 (not shown) during loading and off-loading/launching operations. FIGS. 2A and 2B show an elongatable and retractable gas spring 250 extending from the deck-attachment end 322 of the stanchion 320 to the elbow 343 of the boom 340. It should be noted that the gas spring 250 may alternatively be affixed to and extend from other locations along the stanchion 320, such as more central locations along the stanchion. As outlined below, during heave events in the open water 10 (not shown), the gas spring 250 operates to provide passive heave compensation. It should also be noted that the stanchion 320 may include a stop (not shown) that stops the boom 340 from rotating upwards beyond a predetermined angle.

Figure 3A:
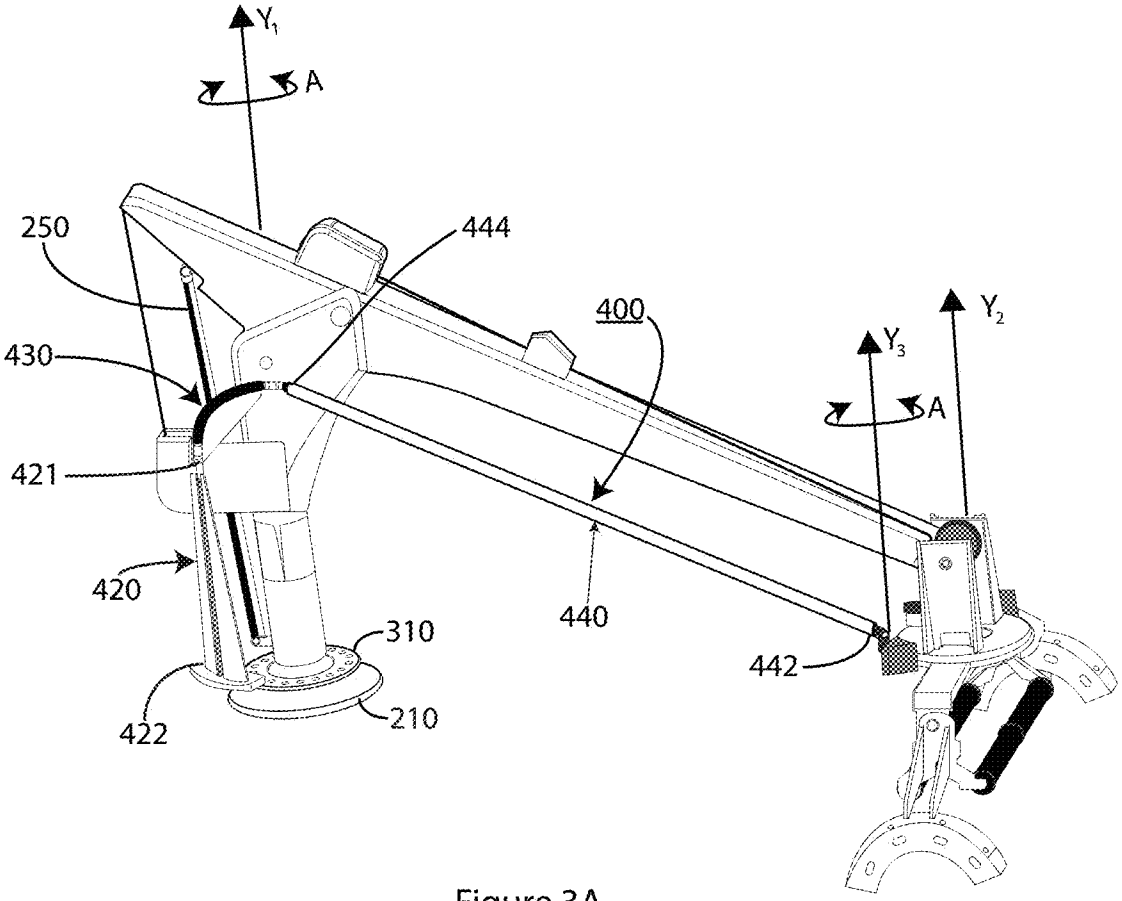
FIGS. 3A, 3B, and 3C are perspective illustrations of the passive heave control arrangement 200, showing the mechanical linkage 400, according to an embodiment of the invention.
Figure 3B:
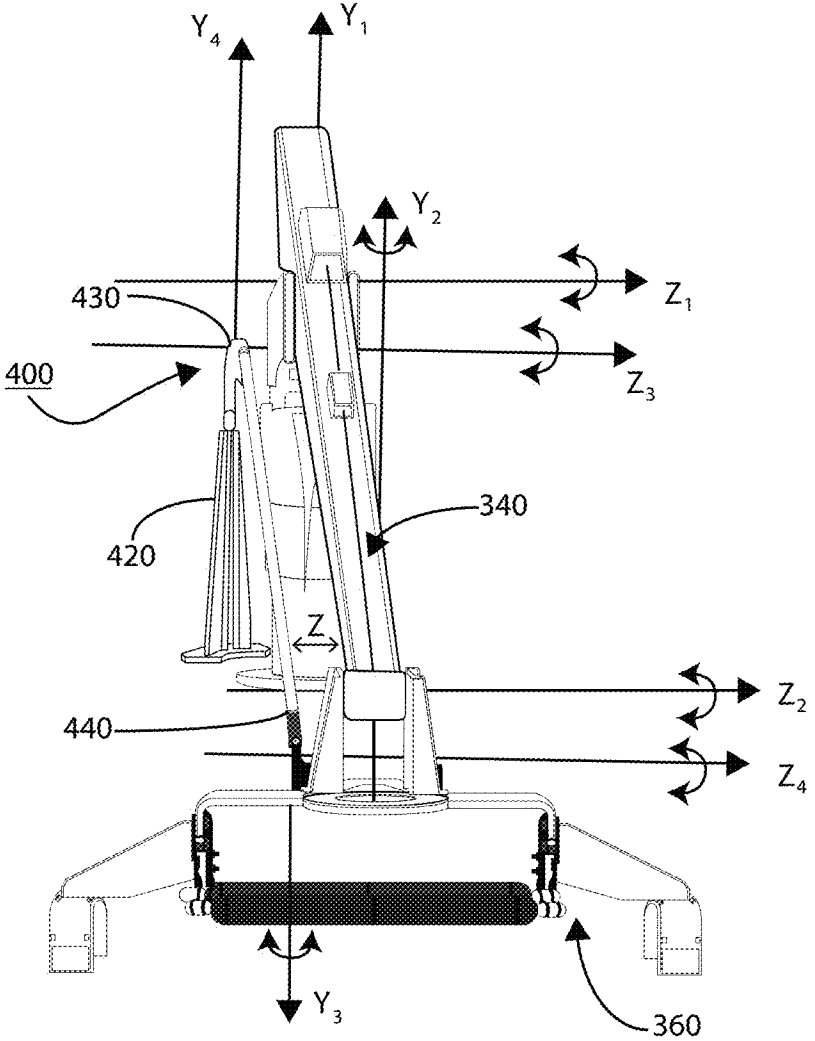
Figure 3C:
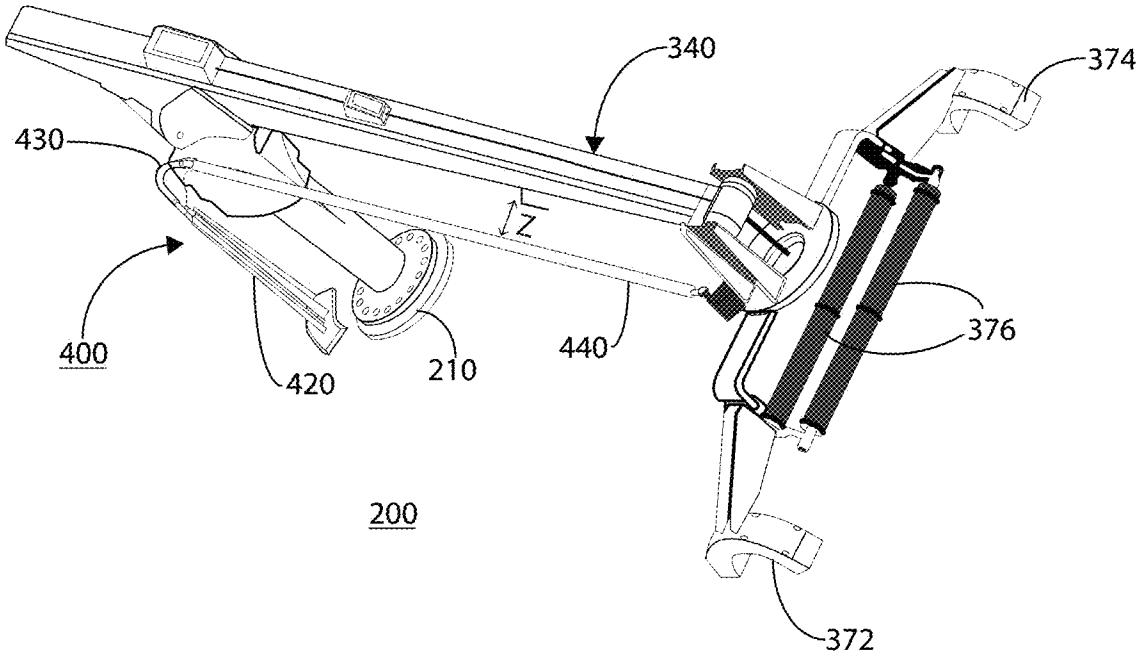

FIGS. 3A, 3B, and 3C are perspective illustrations of the passive heave control arrangement 200, showing the mechanical linkage 400, according to an embodiment of the invention. The illustrations of FIGS. 3A, 3B, and 3C show the arrangement 200 in identical position, but for clarity, shows the elements from different perspectives. FIG. 3C shows the mechanical linkage 400 being laterally displaced in direction z from the stanchion 320 and boom 340 of the davit 300. As outlined below, according to this embodiment, the mechanical linkage 400 helps to keep the centerline of the object parallel to the vessel centerline.

The mechanical linkage 400 is a 3D parallelogram system that keeps the capture head 360 parallel to centerline while rotating about the $Y_1$ axis while still allowing the boom 340 rotate up and down about the $Z_1$ axis. FIGS. 3A, 3B, and 3C show the mechanical linkage 400 having a first arm 420 that extends axially, generally in the vertical direction, the first arm 420 has a deck attachment end 422 and an outer end 421. FIG. 3A also shows a curved portion 430 to which the outer end 421 is attached.

FIGS. 3A, 3B, and 3C show a second arm 440 that extends axially in a direction that is generally the same as the boom 340, which may be horizontal, or at an angle with respect to horizontal. The second arm 440 has a head attachment end 442 and an inner end 444. The second arm 440 head attachment end 442 swivels and rotates about the $Z_4$ and $Y_3$ axes to maintain the parallel to centerline and vertical alignment. Second arm 440 inner end 444 is attached to the curved portion 430, and therefore also rotates about the $Z_3$ axis, via the curved portion 430. It should be noted that the inner end 444 of the second arm 440 is pivotally attached to the curved portion 430 so that the second arm is pivotable about a horizontal axis $Z_3$. It should be noted that the entire arm structure, i.e., the first arm 420, the second arm 440, and the curved portion 430, as a unit, rotates about the vertical $Y_4$ axis.

As shown, the second arm 440 of the mechanical linkage 400 is attached to the swivel disk 361 of the capture head 360. As outlined above, the swivel disk 361 is structured to rotate about a vertical axis $Y_2$. As outlined below, in operation when an object is captured in the capture head 360 and the stanchion rotates about a vertical axis $Y_1$ via the slewing gear (not shown) and slewing gear attachment 310, the capture head 360 rotates about vertical axis $Y_1$, the complementary rotations about the vertical axes $Y_1$ and $Y_2$, keep the object centerline parallel to the vessel centerline, with the assistance of the mechanical linkage 400, which restrains and controls the rotation about vertical axis $Y_2$, keeping the object in the desired orientation.

FIG. 3C also shows more structure of the capture head 360. As shown the capture head includes a first gripper 372, a second gripper 374, and a plurality of elongated cradle bars 376 between the grippers. In operation, the object is held by the first gripper 372 and the second gripper 374, and is cradled by the cradle bars 376. The first the second grippers (372, 374) and the cradle bars 376 help to maintain the object in an orientation so that said object centerline is maintained substantially parallel to the vessel centerline.

Figure 4:
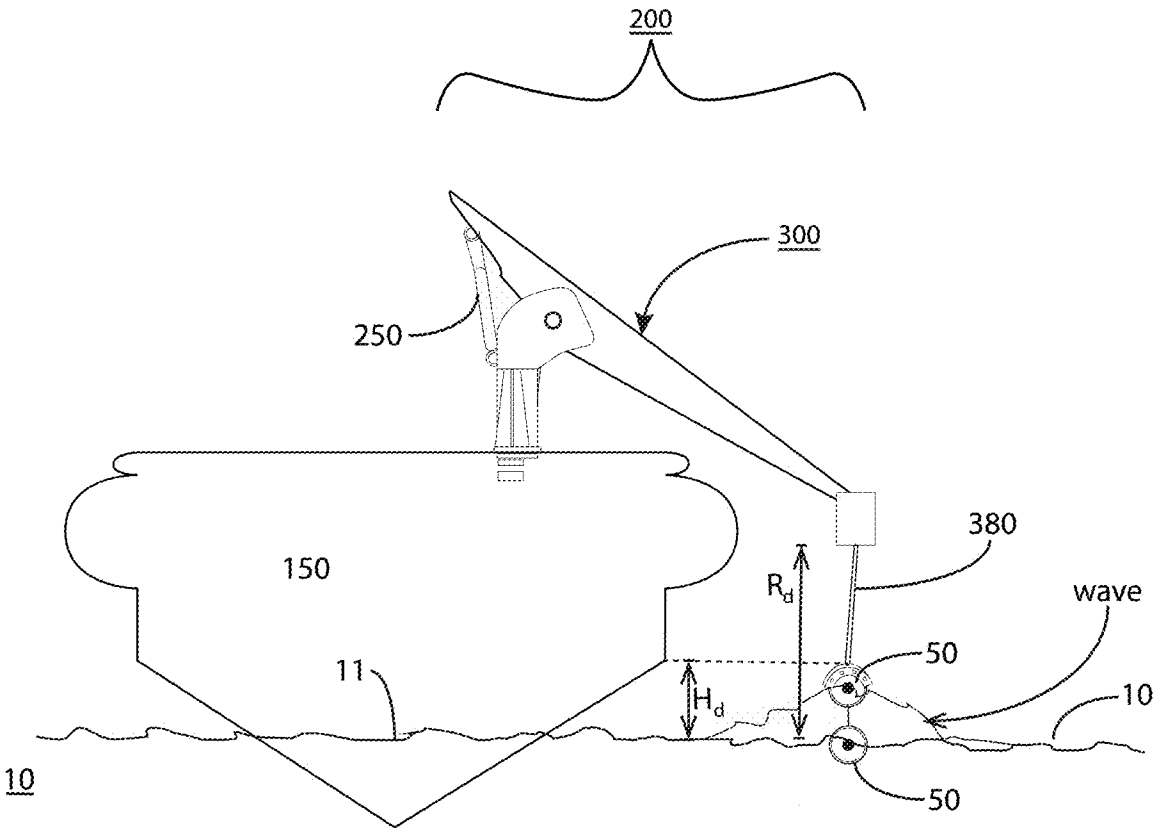
FIG. 4 is an exemplary explanatory illustration of the passive heave compensation system, according to an embodiment of the invention.

FIG. 4 is an exemplary explanatory illustration of the passive heave compensation system 100 for open-water loading and offloading objects on and off the water vessel/parent ship 150, according to an embodiment of the invention. FIG. 4 is an explanatory illustration showing heave event variables and the adjustments made by the passive heave compensation system 100 during heave events. FIG. 4 shows the water vessel 150 in open water 10, the system including the passive heave control arrangement 200 which includes the davit 300. The passive heave control arrangement 200 accommodates for the heave events such as waves associated with the sea states of the open water.

FIG. 4 shows the heave control arrangement 200 during the recovery process in a position in which the object is captured, as outlined with respect to FIG. 5C below. FIG. 4 shows the davit 300 and other elements hanging off a side of the water vessel 150, with the boom 340 angled downwards. The capture head 360 is above the water, with the cable 381 engaging the object 50. FIG. 4 also shows the open water 10 having a waterline region 11 that coincides with the level at which the water vessel 150 floats in the water, and according to this embodiment generally represents the level of the water.

FIG. 4 also shows the object 50 floating in the water 10. The object 50 is held by the second winch cable 381, which extends from the second winch 380, through the capture head 360, and downwards to the object 50. FIG. 4 shows the vertical distance between the capture head 360 and the object 50 is a Reel Distance $R_d$. FIG. 4 also shows a Heave Distance $H_d$, which is the vertical displacement distance the object 50 moves under the force of the water, wherein this Heave Distance $H_d$ is a vertical displacement with respect to the water vessel 150. A heave event will be caused by a wave or the like, which moves the object 50 upwards or downwards, with respect to the water vessel 150, from its initial resting position on the water represented by the level of the waterline 11.

The heave distance $H_d$ has a direct correlation to the gas spring 250 elongation. As waves cause the object to move up and down in relation to the water vessel 150, the tension in the gas spring 250 causes the boom 340 to rotate to maintain the reel distance $R_d$. The lift created by the gas spring 250 is only enough to overcome the weight of the boom 340 and other davit components plus a small margin for inertia. The gas spring 250 does not lift the object 50, and thus compensates for the $H_d$, by maintaining the $R_d$.

FIGS. 5A-5F, are exemplary explanatory illustrations of the passive heave compensation arrangement 200, as it goes through the different stages of capturing and recovering an object 50, according to an embodiment of the invention. Each of the figures, i.e., FIGS. 5A, 5B, 5C, 5D, 5E, and 5F, shows the passive heave compensation arrangement 200 at a different stage of the process. Although the overall system 100 is not shown, it should be understood that the davit 300 and other elements of the arrangement 200 is positioned on the deck of the water vessel, which is in open water. It 5F should also be understood that FIGS. 5A-5F outline only one mode of operation of the passive heave compensation arrangement 200 within the system 100 (shown in FIGS. 1A and 1B), and other modes of operation are possible, such as off-loading or launching an object from the deck of the vessel to the water. However, it should be noted that the function of passively compensating for heave events is consistent, regardless of the specific functions being carried out, i.e., loading, offloading/launching, etc.

FIGS. 5A-5F show davit elements including the stanchion 320, the boom 340, and the capture head 360. FIGS. 5A-5F also show, the first winch (boom winch) 370 positioned on the stanchion 320, and the first winch cable 371. FIGS. 5A-5F also show, the second winch (line winch) 380 positioned on the boom 340, and the second winch cable/line 381, which extends through the capture head 360. A hook 363 is attached at the end of the cable/line 381 for securing the object 50 thereto. FIGS. 5A-5F also show a stop 330 on the stanchion 320 that contacts the elbow region of the boom 340, preventing upward rotation of the boom 340 beyond a desired angle. Also shown in the gas spring 250, which according to this embodiment is positioned at a central part of the stanchion 320, and extends and is connected at the elbow of the boom 320.

Figure 5A:
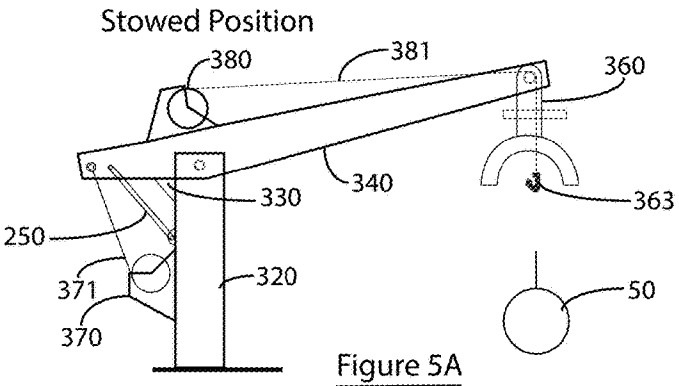
FIGS. 5A-5F, are exemplary explanatory illustrations of the passive heave compensation arrangement, as it goes through the different stages of capturing and recovering an object, according to an embodiment of the invention.

FIG. 5A shows the passive heave compensation arrangement 200 in a stowed position. In operation the arrangement 200 may be positioned in the stowed position when the water vessel/parent ship 150 is transiting from one location to another. In the stowed position the boom winch 370 has put the tension in the line 371 to pull the boom 340 down on the up stop 330. The gas spring 250 is fully retracted. The line winch 380 retracts the line 381 so that the hook is secure.

Figure 5B:
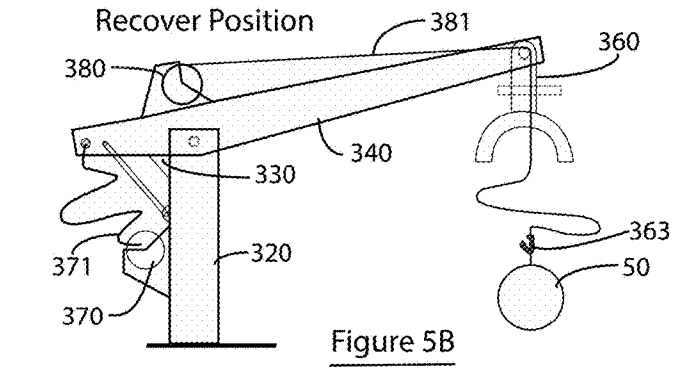

FIG. 5B shows the passive heave compensation arrangement 200 in a recover position. In the recover position the arrangement 200 including the davit 300 is ready to recover the object 50. In the recovered position the boom winch 370 pays out the cable/line 371 so that the boom 340 can articulate. It should be noted that although the line is paid out, articulation does not occur until prompted by the force/weight of the object 50. The line winch 380 pays out the cable 381 so that the object could be captured with the hook 363. As shown the cable 381 is not under tension. At this stage the object is floating in the open water. The tension in the gas spring 250 keeps the boom 340 up against the up stop 330.

Figure 5C:
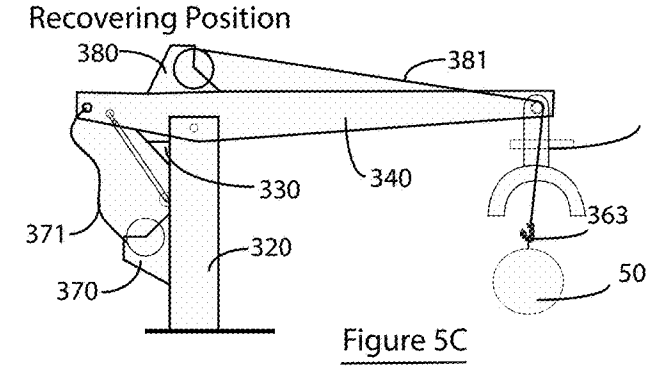
Figure 5D:
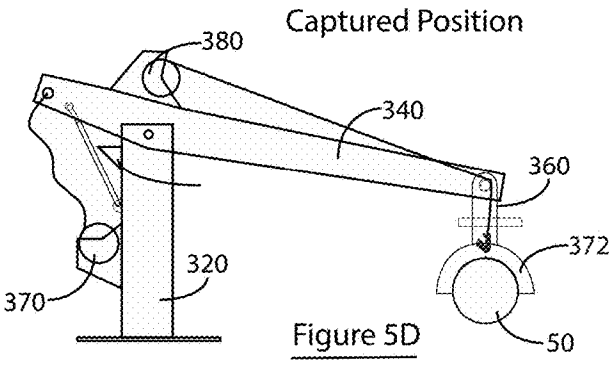

FIG. 5C shows the passive heave compensation arrangement 200 in a recovering position. This is a stage at which the gas spring 250 compensates for heave events. In the recovering position the object 50 is still afloat in the open water, but has been hooked. The line winch 380 retrieves and continues to retrieve the cable 381 to the point at which the cable 381 is taut. The weight of the object 50 extends the gas spring 250. The retrieving cable/line 381 pulls the boom 340 and capture head down 360 towards the object 50. In this position, heave events may cause a vertical displacement distance $H_d$ (the vertical displacement distance the object 50 moves under the force of the water with respect to the water vessel 150), which is compensated for. This is accomplished by the gas spring 250 elongating if the object 50 goes down or retracting if the object 50 goes up, to negate the vertical displacement distance $H_d$. As shown in FIG. 3C, the cable line 371 is paid out and loose, and thus articulation of the boom 340 at this stage is effected by the gas spring 250 and the weight of the object, and not the first winch 371. FIG. 5D shows the passive heave compensation arrangement 200 in a captured position. This is also a stage at which the gas spring 250 compensates for heave events. In the captured position the line winch 380 has retrieved the cable/line 381 till the boom 340 and capture head 360 are pulled completely down to the object 50 so that the object 50 is secured into the capture head 360. As state above, this position is still heave compensated by the gas spring 250 which is extended further than the previous position. Thus, even though the reel distance $R_d$ is zero, the gas spring 250 effect adjusts for heave events and the accompanying vertical displacement distance $H_d$.

Figure 5E:
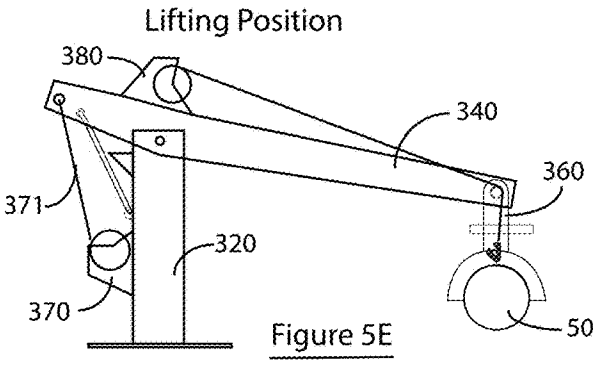
Figure 5F:
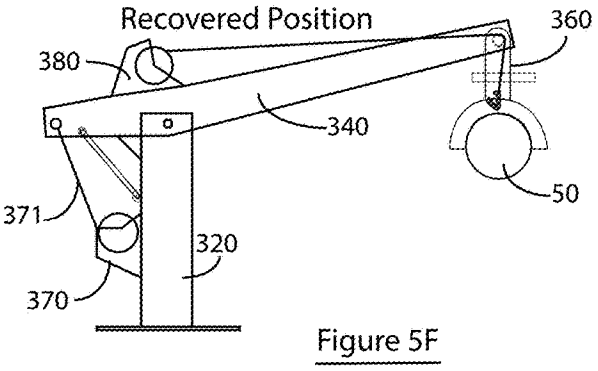

FIG. 5E shows the passive heave compensation arrangement 200 in a lifting position. In the lifting position the boom winch 370 retrieves cable 371 to begin lifting the object 50 from the water. After the object 50 is lifted, there is no need for heave compensation as the object is no longer directly affected by heave events. FIG. 5F shows the passive heave compensation arrangement 200 in a recovered position. In the recovered position, the boom winch 370 has retrieved cable 371 until the boom 340 is against the up stop 330.

Figure 6A:
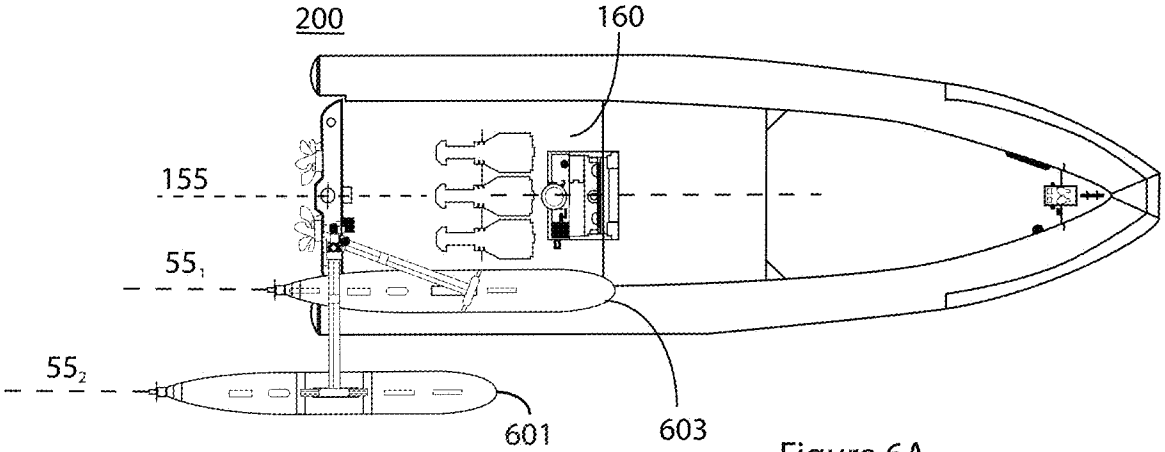
FIG. 6A is an exemplary top view of the loading or offloading of an object, onto or off the water vessel, according to an embodiment of the invention.

FIG. 6A is an exemplary top view of the loading or offloading of an object, onto or off the water vessel, according to an embodiment of the invention. FIG. 5A shows the water vessel 150 having a vessel centerline 155 extending in a bow-to-stern direction. FIG. 6A shows the upper deck 160. According to the illustration, the water vessel 150 is afloat on a body of water 10. FIG. 6A shows the object 50 in a launch/recovery position 601 when captured on the water 10, and in a stowed position 603 on the upper deck 160. The object centerline 55, extends axially through the object 50 when the object 50 is in the launch/recovery position. The object centerline 552 extends axially through the object 50 when the object 50 is in the stowed position. As shown, in positions 601 and 603, the object centerline 55, and 552 is maintained parallel to the vessel centerline 155.

Figure 6B:
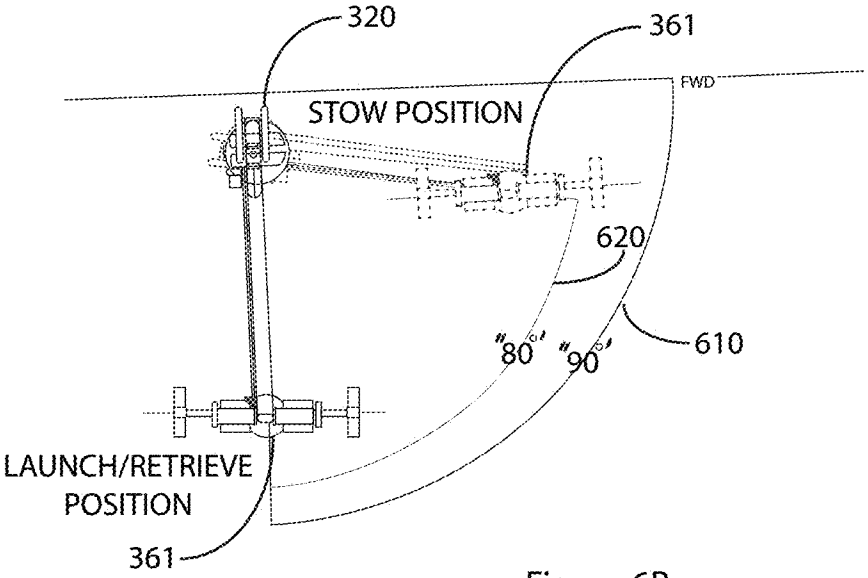
FIG. 6B is an explanatory illustration, showing the rotation about the vertical axis through the stanchion, and the rotation about the vertical axis through the swivel plate, according to an embodiment of the invention.

Throughout the process of moving from the loading or offloading position to the stowed position and vice versa, the object centerline is maintained parallel to the vessel centerline 155. FIG. 6B is an explanatory illustration, showing the rotation about the vertical axis through the stanchion 320 $Y_1$, and the rotation about the vertical axis through the swivel plate 361, and axis $Y_1$, according to an embodiment of the invention. FIG. 5B shows a first arc 610, an unadjusted arc at 90 degrees, and the adjusted second arc 620. The second arc 620 shows the adjustment in rotation about the swivel plate 361, and axis $Y_2$ caused by the mechanical linkage 400, which controllably restrains the rotation about $Y_2$, so that the centerlines 55 and 155 are parallel to each throughout the entire arc of movement, i.e., from the loading/offloading position to the stowed position.

Returning to FIGS. 3A-3C, the apparatus and process involved in maintaining the centerlines 55 and 155 parallel to each other is illustrated. As stated above, during the loading or offloading/launching process when an object is captured in the capture head 360, the stanchion 320 may rotate about a vertical axis $Y_1$ via the operation of the slewing gear. Because the capture head 360 is attached to the boom 340, the capture head rotates with the stanchion 320 about a vertical axis $Y_1$ as well. As shown, the capture head 360 rotates about vertical axis $Y_2$, via the operation of the swivel disk 361. However, the rotation about vertical axis $Y_2$ is restrained and controlled by the second arm 440 of the mechanical linkage 400, which is connected to the swivel disk 361. The object centerline 55 is kept parallel to the vessel centerline 155 (as shown in FIG. 5) by the mechanical linkage's control of the rotation of the capture head 360 about vertical axis $Y_2$ while the stanchion 320 rotates about axis $Y_1$.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A passive heave compensation system for the at-sea loading and unloading of objects on a water vessel, the system comprising:

a water vessel having a bow and a stem, and a vessel centerline extending in a bow-to-stem direction, the water vessel having an upper deck, and wherein the water vessel is afloat in a body of water;

an object to be loaded and/or unloaded onto or from the water vessel, the object having an object centerline;

a passive heave compensation arrangement comprising:

a slewing gear attached to the upper deck of the water vessel;

a stanchion extending axially in the vertical direction, wherein the stanchion has a deck-attachment end and a boom-attachment end, and wherein the deck-attachment end is attached to the upper deck via the slewing gear so as to be rotatable about a vertical axis;

a boom extending axially and generally in the horizontal direction or at an angle to the horizontal direction, the boom having a stanchion-attachment end with an elbow thereat, and a head-attachment end;

a first pin having an elongated first pin axis, wherein the boom is attached to the stanchion via the first pin, the boom pivotable with respect to the stanchion about the first pin axis;

a capture head attached to the head-attachment end of the boom for capturing and cradling an object;

a first winch on the stanchion, the first winch including a first winch cable connected to the elbow of the boom, whereat the first winch manipulates the pivoting motion of the boom about the first pin axis;

a second winch on the boom, the second winch including a second winch cable that extends into the capture head and is connectable to the object, whereat the second winch manipulates capturing and cradling of the object from either the upper deck or the body of water, and wherein in the at-sea capturing and cradling of the object that is floating in the body of water, the vertical distance between the capture head and the object is a Reel Distance $R_d$, and wherein during a heave event a Heave Distance $H_d$ is the vertical displacement distance, with respect to the water vessel, the object moves under a force of the water, and wherein the vertical displacement distance may be an upward displacement or a downward displacement;

an elongatable and retractable gas spring extending from the stanchion to the elbow of the boom, wherein during a heave event the gas spring provides passive heave compensation by elongating if the Heave Distance $H_d$ moved by the object is a downward displacement or retracting if the Heave Distance $H_d$ moved by the object is an upward displacement, to negate the vertical displacement distance $H_d$ applying a force to move the boom by the Heave Distance $H_d$, thereby keeping the Reel Distance $R_d$ constant during the heave event.

2. The passive heave compensation system of claim 1, further comprising a mechanical linkage having:

a first arm that extends axially in the vertical direction, the first arm having a deck attachment end and an outer end; and a second arm that extends axially in the horizontal direction, the second arm having a head attachment end and an inner end;

a curved portion between the first arm and the second arm wherein the first arm is fixedly attached to the deck, and wherein the outer end of the first arm is hingedly attached to the curved portion, and wherein inner end of the second arm is attached to the curved portion, and wherein the passive heave compensation arrangement further comprises a head-attachment assembly attached to the head-attachment end of the boom, the head-attachment assembly having a first plate and a second plate, wherein each of the first plate the second plate is pivotable through a horizontal pivot axis $Z_2$ through which the capture head freely pivots to maintain the horizontal orientation of the object, and wherein each of the first and second plate is attached to a swivel disk through which the capture head swivels about a vertical axis $Y_2$, and wherein the second arm of the mechanical linkage is attached to the swivel disk so that when an object is captured in the capture head and the stanchion rotates about the vertical axis via the slewing gear, the object centerline is maintained substantially parallel to the vessel centerline.

3. The passive heave compensation system of claim 2, wherein the capture head comprises a first gripper, a second gripper, and a plurality of cradle bars therebetween, wherein the object is gripped by the first gripper and the second gripper, and is cradled by the cradle bars, the first gripper the second gripper and the cradle bars holding the object in an orientation so that said object centerline is maintained substantially parallel to said vessel centerline.

* * * * *